United States Patent [19]

Setterberg, Jr. et al.

[11] Patent Number: 4,846,270

[45] Date of Patent: Jul. 11, 1989

[54] TRASH BARRIER TOOL FOR WELLS

[75] Inventors: John R. Setterberg, Jr., Dallas, Tex.; Robert D. Harrison, Jr., Bakersfield, Calif.

[73] Assignee: Otis Engineering Corporation, Dallas, Tex.

[21] Appl. No.: 178,485

[22] Filed: Apr. 7, 1988

[51] Int. Cl.[4] ..... E21B 23/00; F16L 27/12; F16L 55/24

[52] U.S. Cl. ..... 166/115; 166/214; 166/242; 285/3; 285/39; 285/302

[58] Field of Search ..... 166/115, 117.7, 177, 166/212, 214, 237, 240, 242; 285/298, 302, 3, 4, 23, 2, 24, 26, 29, 39, 85, 86, 370, 397, 313, 317, 319, 320, 322; 175/321, 322

[56] References Cited

U.S. PATENT DOCUMENTS

| | | | |
|---|---|---|---|
| 3,136,366 | 6/1964 | Brown et al. | 285/319 X |
| 3,910,349 | 10/1975 | Brown et al. | 285/302 X |
| 4,281,711 | 8/1981 | Braddick et al. | 166/118 |
| 4,281,858 | 8/1981 | Bowyer | 285/302 X |
| 4,289,202 | 9/1981 | Henderson | 166/214 X |
| 4,391,326 | 7/1983 | Greenlee | 285/319 X |
| 4,423,889 | 1/1984 | Weise | 285/302 X |
| 4,433,725 | 2/1984 | Bowyer | 285/302 X |
| 4,449,736 | 5/1984 | Blackwell | 166/214 X |
| 4,570,707 | 2/1986 | Setterberg, Jr. | 166/214 |

*Primary Examiner*—Bruce M. Kisliuk
*Attorney, Agent, or Firm*—Johnson & Swanson

[57] ABSTRACT

A well tubing extension joint including a trash barrier. A top sub having an internal locking recess is connected on the upper end of a well packer mandrel. A trash barrier is connected on the lower end of an upper tubing string for releaseably engaging the top sub to permit the upper tubing string to move longitudinally relative to the packer and packer top sub. The trash barrier includes a body having locking collet fingers for releaseably locking the body in the top sub at the locking recess. The body has external rings seals for sealing with the top sub and an internal wiper seal for sealing with the upper tubing string extending through the body. The upper tubing string has a seal moveable along the packer bore and includes a tubing joint coupling which is releaseably connectible in the trash barrier body permitting the trash barrier to be run into the well and landed and locked in the top sub, and thereafter the tubing string is released from the body for longitudinal movement in sealed relationship through the wiper seal. In two forms of the invention the upper tubing string is connected to the trash barrier assembly body only by shear pins. In the other form of the invention, the coupling is connected by shear pins and a threaded connection.

10 Claims, 5 Drawing Sheets

TRASH BARRIER TOOL FOR WELLS

FIELD OF THE INVENTION

This invention relates to well tools particularly useful in oil and gas wells, and more particularly, relates to a trash barrier for a tubing string extension joint.

HISTORY OF THE PRIOR ART

In the oil and gas industry a number of different types of wells use tubing string extension joints which permit telescoping movement of one portion of a tubing string relative to another portion of the string to compensate for temperature changes, to make adjustments between the wellhead and a packer in the well, and to satisfy other similar requirements. Such a tool is particularly useful in steam injection wells where steam is forced into an oil producing formation through an injection well to drive oil through the formation to a producing well. Obviously, in such a situation temperature changes cause expansion and contraction of the tubing strings. Also, such tools are useful in deep sour gas well applications and in wells where cool acid is introduced into a hot well. In well completion of these types including extension joints, foreign material or trash can be a major problem which will cause pipe to stick and will damage seals pipe, and seal bore, such as in packers when one portion of a tubing string moves in another portion of the string as the well temperature changes. In steam injection wells, sand backflow can be a very damaging problem when the sand collects on a packer between tubing sections.

SUMMARY OF THE INVENTION

It is a particularly important object of the invention to provide a new and improved trash barrier for use in oil and gas wells.

It is another object of the invention to provide a trash barrier protected tubing extension joint particularly useful in steam injection wells, deep sour gas wells, and the like.

It is another object of the invention to provide a tubing string extension joint including a trash barrier which is removable from a well bore with the tubing string.

It is another object of the invention to provide a tubing string extension joint having a trash barrier which may be used with a standard packer and will protect even with rough, ordinary pipe.

In accordance with the invention, there is provided a trash barrier for a tubing string extension joint including a tubing head connectible on the upper end of a lower tubing string or packer mandrel and having an internal locking recess therein, a trash barrier body having a latch releaseably engageable with the latch recess in the tubing head, seal rings on the body for sealing between the body and the tubing head, a wiper seal in the body for slidable engagement with the outer surface of a tubing string to permit the tubing string to slide within the seal while preventing trash from falling down along the tubing string surface below the seal, and structure for releaseably connecting the tubing string with the trash barrier body and releasing the string for sliding movement in the trash barrier body when the trash barrier is latched in the tubing head. In one embodiment of the invention, the trash barrier is connectable by shear pins to the upper tubing string, and releasable by downward force only on the tubing string. In another embodiment of the invention the trash barrier body is latched into the top sub to prevent the body from turning and the upper tubing string is connected by threads to the body so that the tubing string is released by rotation from the trash barrier body. A further embodiment of the trash barrier is latched into the tubing head with the last downward movement and the extension joint is released with the next upward movement of the tubing string.

BRIEF DESCRIPTION OF THE DRAWINGS

The foregoing objects and advantages of the invention will be better understood from the following detailed description of a preferred embodiment of the trash barrier of the invention taken in conjunction with the accompanying drawing wherein.

DETAILED DESCRIPTION OF THE PREFERRED EMBODIMENT

Figure 1:
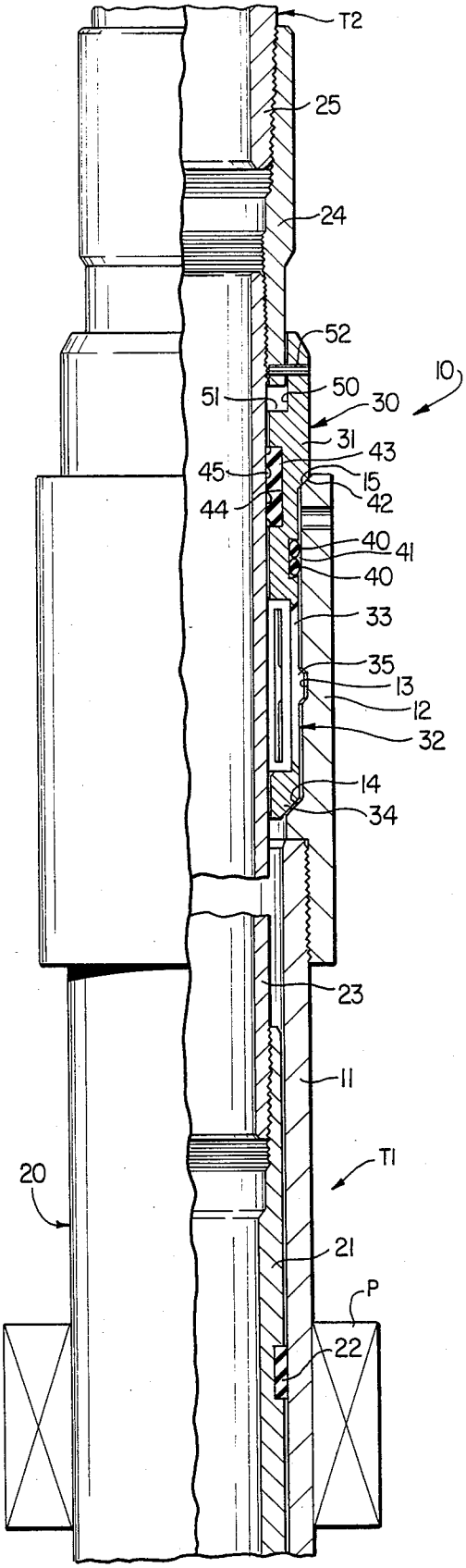
FIG. 1 is a fragmentary longitudinal view in section and elevation of a tubing string extension joint with a trash barrier connecting an upper tubing string with the upper end of a lower tubing string or mandrel of a packer schematically illustrated.

Referring to FIG. 1, a tubing extension joint 10 including a trash barrier embodying the features of the invention connects the upper end of a lower tubing string T1 with the lower end of an upper tubing string T2 extending to a wellhead, not shown, at the surface. The well system represented in the drawings is similar to the well completion shown in FIG. 1 of U.S. Pat. 4,289,202 issued Sept. 15, 1981. The well completion shown in FIG. 1 of the reference patent includes a packer set in a well casing and defining the upper end of a lower tubing string T1, the upper tubing string T2 being connectible with the lower string by an extension joint. In the present application, in FIG. 1, the upper end of the lower tubing string T1 includes a packer P for sealing around the tubing string with the well casing, as shown in the reference patent, and a packer mandrel 11 which is a component part of the packer and defines the bore of the packer opens into the upper end of the lower tubing string. A top sub 12, which also forms the head of the lower tubing string T1 is connected, as illustrated, on the upper end of the well packer mandrel 11. The top sub 12 has an internal landing and latch recess profile including a latch recess 13 and a stop shoulder 14. The upper end of the sub has a downwardly and inwardly tapered shoulder 15.

As shown in FIG. 1, an internal tubing assembly 20 including a tubing joint 21 and a seal 22 mounted on the tubing joint 21 is connected on the lower end of a tubing joint 23 secured by a coupling 24 to the threaded lower end 25 of the upper tubing string T2. The seal 22 is designed to effect a slidable fluid tight contact with the inner surface of the packer 11 to prevent leakage of well fluids below the packer P upwardly along the space between the lower end portion of the upper tubing string and the bore surface of the packer mandrel thereby confining fluid flow below the packer P to the bore into the upper tubing string T2.

In accordance with the invention, a trash barrier assembly 30 is mounted on the tubing joint 23 of the upper tubing string T2. The trash barrier includes a body 31 and an integral collet 32 dependent from the body 31. The collet is formed by a plurality of circumferentially spaced longitudinal collet fingers 33 extending downwardly and joined together at lower ends by a ring portion 34. Each of the collet fingers has a central external locking boss 35. The bosses 35 are shaped to fit the locking recess 13 in the top sub 12 for releaseably locking the trash barrier in the top sub. A pair of ring seals 40 are mounted in a external annular recess 41 around the lower end portion of the body 31 for sealing between the body and the bore of the top sub 12. The body 31 has an external annular stop shoulder 42 for supporting the body on the stop shoulder 15 of the top sub 12. A wiper seal 43 is mounted in an internal annular recess 44 providing a trash barrier between the body 31 and the tubing joint 23. The wiper seal is shaped to provide internal longitudinally spaced annular recesses 45. One form of wiper seal is molded of rubber or a rubber-like material having a hardness of about 90 durometers. Depending upon well conditions, other materials and hardnesses may be used. The wiper seal 43 forms a sliding fit with the outer surface of the tubing joint 23 allowing the tubing to move upwardly and downwardly within the seal while keeping debris within the well above the seal from moving downwardly along the outer surface of the tubing. The body 31 has a counter-bore 50 above a stop shoulder 51 sized to receive the lower end portion of the coupling 24 connecting the trash barrier with the tubing string T2. The body 31 is releaseably connected on the lower end of the coupling 24 by shear pins 52, as seen in FIG 1. The coupling 24 is shear pinned in the body 31 with the lower end edge of the coupling spaced above the stop shoulder 51 to provide room for the lower end of the coupling to move downwardly sufficiently to shear the pins 52 to release the coupling from the trash barrier body.

In operation, the first step in the completion of a well as schematically represented in FIG. 1 is the running and setting of the packer P with those portions of the lower tubing string T1 required for the particular installation. The packer and the lower tubing string components along with the packer mandrel 11 and the top sub 12 secured on the packer mandrel are run as a unit using standard equipment and techniques, such as wireline apparatus and methods. The trash barrier 30 is then made-up on the upper tubing string T2. The trash barrier is connected by the coupling 24 with the threaded pin portion 25 of the tubing string T2. The tubing joint 23 is connected into the coupling 24 and the trash barrier 30 is installed on the tubing joint 23 with the wiper seal 43 in position in the internal recess 44 of the body 31. The ring seals 40 are installed in the recess 41 of the body 31. The body 31 is secured by shearpins 52 to the lower end of the coupling 24, as shown in FIG. 1. The end edge of the coupling 24 is spaced above the stop shoulder 51 in the body 31. After the trash barrier is installed on the tubing joint 23, the tubing joint 21 carrying the external annular seal 22 is threaded on the lower end of the joint 23. The tubing string T2 including the joint 21 with the seal 22 and the trash barrier 30 is run into the well bore until the trash barrier body 31 is landed in the top sub 12 of the packer with the stop shoulder 42 on the body 31 resting on the top shoulder 15 of the top sub. As the trash barrier is stabbed into the top sub, the collet fingers 33 on the body 31 are all compressed inwardly permitting the housing to telescope into the top sub. When the looking bosses 35 on the collet fingers are aligned with the locking recess 13 in the top sub, the collet fingers spring back outwardly releaseably locking the body 31 in the top sub at the position shown in FIG. 1. At this position of the trash barrier, the tubing joint 21 with the seal 22 is disposed through the packer mandrel 11 with the seal 22 engaging the polished surface within the mandrel through the packer. A downward force is then applied to the tubing string T2 sufficiently to shear the pins 52 releasing the tubing string at the coupling 24 from the trash barrier body 31. As the downward force is applied to the tubing string, the lower end edge of the coupling 24 is free to move downwardly in the counterbore 50 of the housing 31 until the end edge engages the stop shoulder 51 in the housing. This is sufficient movement to fully shear the pins 52 to free the tubing string T2 from the trash barrier body. The tubing string T2, including the tubing joint 21 with the seal 22,, is then free to move upwardly from the position of FIG. 1 sufficiently for the required spacing-out and to allow the tubing string to be suspended at a position at which the string may expand and contract in response to temperature changes in the well. In accordance with the invention, the trash barrier 30 remains latched in the top sub 12 holding the wiper seal 43 engaged with the outer surface of the tubing joint 23 as the tubing string expands and contracts, keeping the outer surface of the tubing joint 23 free from sand and other foreign matter in the well bore above the packer which normally would settle into the lower tubing string T1 around the portion of the upper tubing string extending through the packer. The wiper seal, thus, prevents damage by sand and other debris to the outer surface of the tubing joint 23 and the inner surface of the lower tubing string T1 below the wiper seal and the ring seals 40 in the top sub 12. Most importantly, the upper tubing string T1 may freely move longitudinally with respect to the lower tubing string T2 under thermal or hydraulic influences without fear of parting damage due to seizure between the two.

The upper tubing string T2 may be pulled at anytime for servicing the trash barrier, and for other well servicing requirements. The tubing string T2 is pulled upwardly with the tubing joint 25, the coupling 24, the tubing joint 23, and the tubing joint 21 with the seal 22 moving upwardly relative to the trash barrier 30 until the upper end edge of the tubing joint 21 engages the lower end edge of the ring portion 34 of the trash barrier body 31. Continued upward force on the housing 31 cams the locking bosses 35 on the collet fingers 33 radially inwardly compressing the collet fingers until the bosses 35 release from the locking recess 13 in the top sub 12 thereby freeing the trash barrier from the top sub 12. The tubing string T2 is then pulled from the well bore with the trash barrier on the tubing joint 23 resting on the upper end edge of the tubing joint 21. At the surface, the trash barrier may be serviced by replacement of the wiper seal 43, the ring seals 40, and the trash assembly may be reattached to the coupling 24 by shear pins 52 for rerunning the upper tubing string with the trash barrier by into the well. The tubing string is rerun as previously described.

Figure 4:
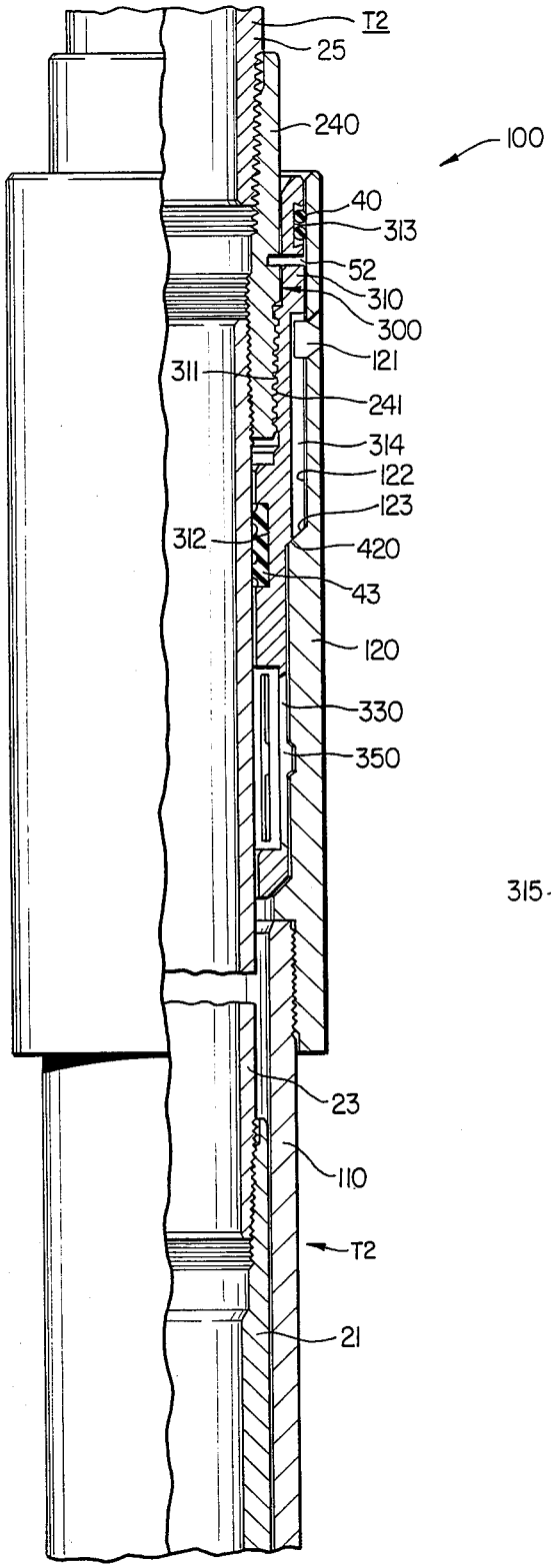
FIG. 4 is a fragmentary longitudinal view in section and elevation of another embodiment of the trash barrier of the invention.
Figure 5:
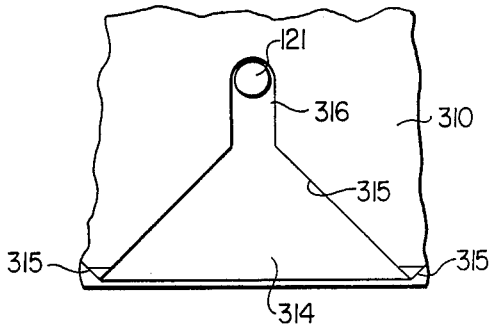
FIG. 5 is development in one plane of the guide recess on the trash barrier of FIG. 4.

FIGS. 4 and 5 illustrate a second embodiment of the invention wherein the upper tubing T2 is released from the trash barrier by rotation of the tubing string, rather than a longitudinal downward force on the string. In FIGS. 4 and 5 identical components of the well system illustrated are given the same reference numerals as used in the system illustrated in FIG. 1. Referring to FIGS. 4 and 5, a tubing string extension joint 100 embodying the features of the invention is employed to couple the upper tubing string T2 with the lower tubing string T1 in a well bore as previously discussed. The upper tubing string T2 includes tubing joint 25, a tubing coupling 240, a tubing joint 23, and a tubing joint 21 which includes the seal 22 as previously described. The coupling 240, like the coupling 24, has internally threaded upper and lower end portions. The coupling 240 is provided with a lower end portion which is externally threaded at 241. Preferably the internal threads are right-hand threads, while the threads 241 are left-hand threads, so that the threads 241 may be disengaged without loosening the internal threaded connections. A trash barrier 300 embodying the features of the invention is connectible on the tubing string T2 at the coupling 240. The trash barrier 300 has a tubular housing 310 having a central portion provided with internal threads 31 for securing the housing with the threads 241 on the coupling 240. The housing 310 has an internal recess 312 for the wiper seal 43. The upper end portion of the housing 310 has an external recess 313 for the ring seals 40. The lower end portion of the housing 310 includes integral longitudinal collet fingers 330 provided with external locking bosses 350 which are shaped and function like the collet fingers 33, as previously described. The housing 310 has an external annular tapered stop shoulder 420 for supporting the housing at the position illustrated within the top sub 120 connected on the packer mandrel 110. The body 310 is connected by shear pins 52 on the coupling 240. The housing 310 has two or more external slots 314 each having a downwardly and outwardly flared portion 315 and an upper narrow slot portion 316 having parallel sidewalls as seen FIG. 5. The lower open end of each locating slot 314 extends partially around the body 310 so that the slot will properly guide the body at whatever position of rotation the body lands in the top sub 120 when running the upper tubing string T2. The top sub 120 has internal lugs 121 which projects inwardly into the enlarged upper end bore portion 122 of the top sub above the stop shoulder 123. The lugs 121 are equal in number and spaced around the top sub to register with slot portions 316 in the body 310. The lugs 121 are slightly smaller in diameter than the width of the slots 316 in the body 310 and extends inwardly sufficiently to engage the slots 314 on the body, so that when the body 310 is inserted into the top sub 120 the lugs 121 engage the slots 314 to orient the body to the position represented in FIG. 5 at which the each 121 enters a slot portion 316 to hold the body 310 against rotation at the landed and locked position in the top sub.

In the well system illustrated in FIGS. 4 and 5 the upper tubing string T2 with the trash barrier 300 is assembled in the same manner as previously described. The trash barrier body 310 including the ring seals 40, and the wiper seal 43 is threaded on the coupling 240 which connects the tubing joints 23 and 25. The body 310 is secured by the threads 241 and 311, respectively, on the coupling 240 and locked against rotation by the shear pins 52 which extend through the body into the coupling. The tubing string including the trash barrier is run into the well bore and telescoped into the lower tubing string T2 until the trash barrier body 310 is landed in the packer top sub 120. As the trash barrier is telescoped into the top sub, the body 310 moves downwardly into the upper end of the top sub with the lug 121 of the top sub entering the guide recess 314 on the body 310. Unless the body enters at a position of rotation at which the lug 121 is in exact vertical alignment with the recess portion 316, the lug will engage one of the side edge surfaces 315 of the guide recess causing the body 310 with the tubing string T2 to be cammed rotationally as the tubing string is lowered until the recess portion 316 on the body 310 passes downwardly on the lug 121 to the position shown in FIG. 5 to look the body 310 against rotation in the top sub. As the upper end portion of the recess 316 moves along the lug, the stop shoulder 420 on the body 310 engages the stop shoulder 123 within the top sub 120 at which point the body 310 comes to rest in the top sub and is locked against rotation. The tubing string T2 is then rotated shearing the pins 52 which releases the tubing string including the tubing joints 21 and 23. The tubing string T2 is rotated until the threads 241 on the coupling 240 disengaged from the threads 311 in the trash barrier body 310. The tubing string T2 may then freely move longitudinally within the lower tubing string T1 through the wiper seal 43 as previously described. The tubing string T2 is pulled to the surface for servicing the trash barrier assembly and other purposes as previously discussed.

Figure 2:
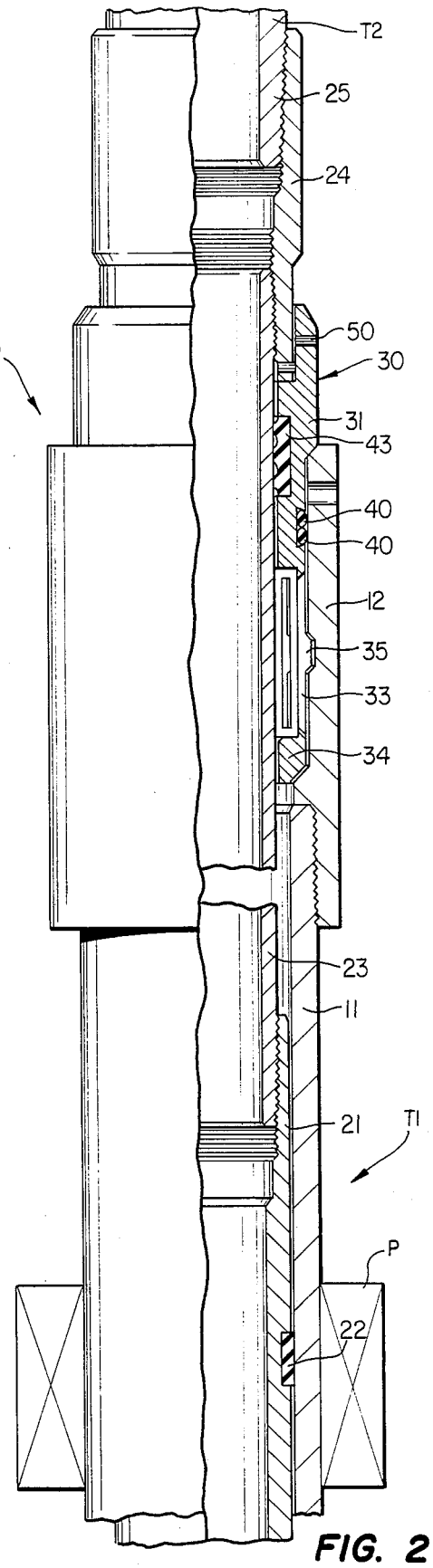
FIG. 2 is a longitudinal view in section and elevation similar to FIG. 1 showing the upper tubing string released for telescoping movement relative to the lower tubing string.
Figure 2A:
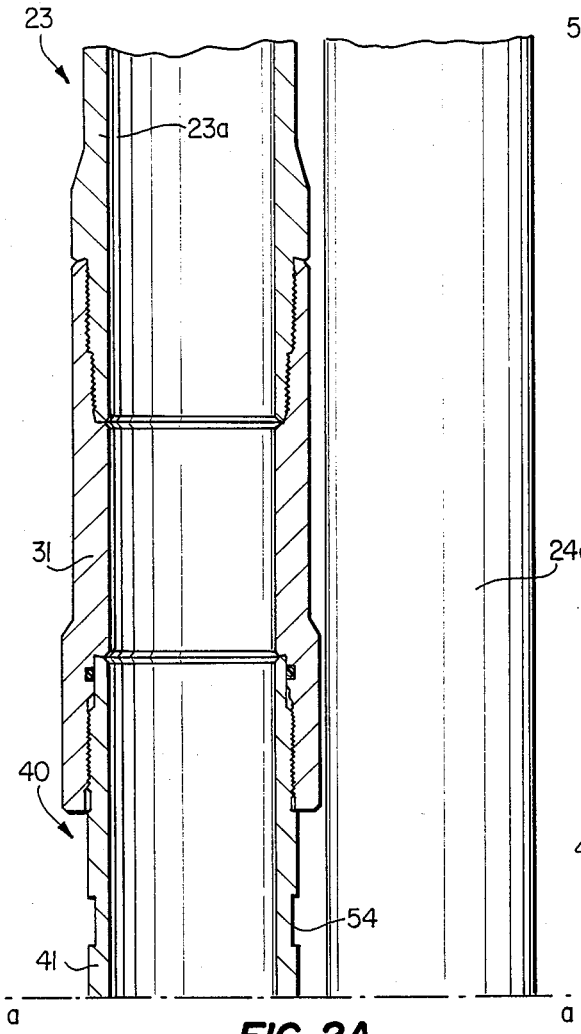
FIGS. 2A, 2B, and 2C together form a longitudinal fragmentary view in section and elevation of the present invention incorporated in the structure of a latch device disclosed in U.S. Pat. No. 4,570,707, issued Feb. 18, 1986.
Figure 2B:
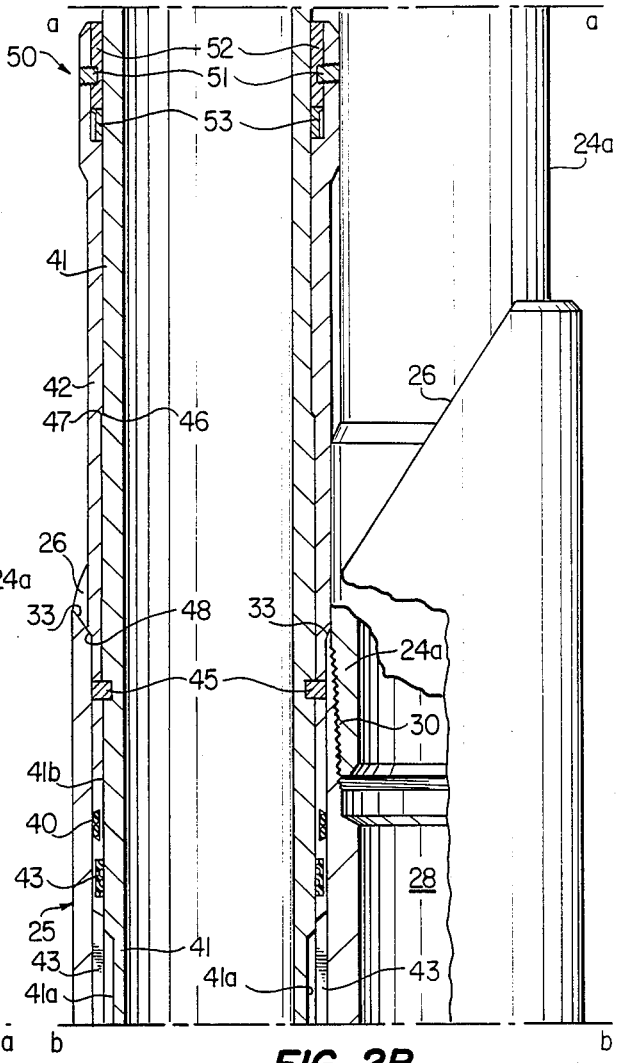
Figure 2C:
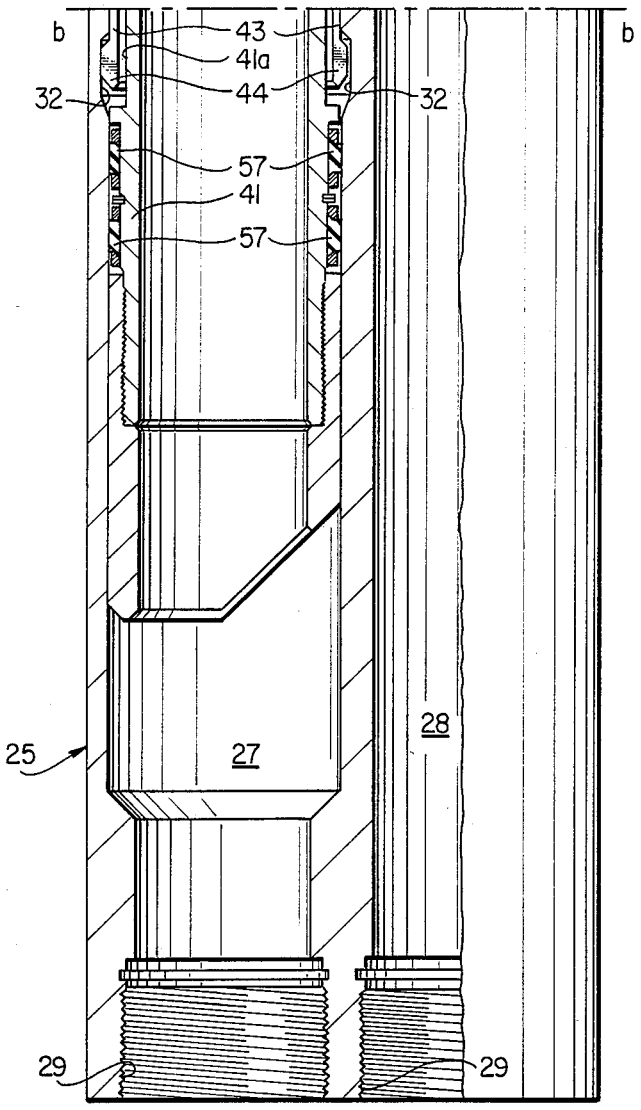
Figure 3:
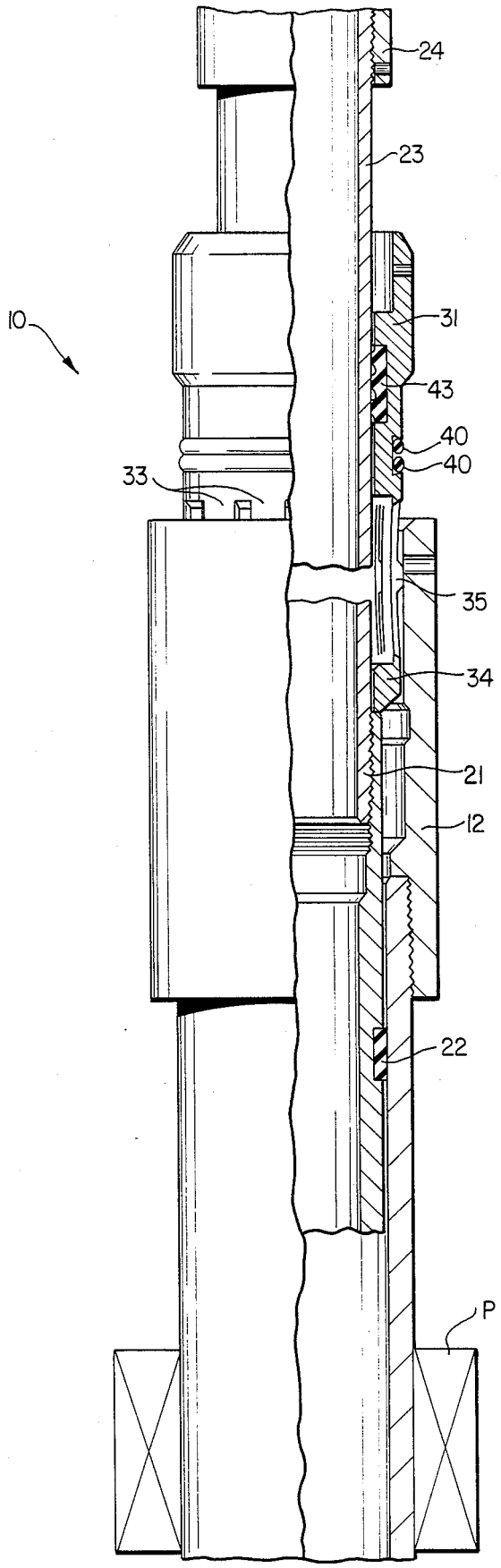
FIG. 3 is a longitudinal view in section and elevation similar to FIGS. 1 and 2 showing the trash barrier released from the tubing head and being pulled from the well bore with the upper tubing string.

Another embodiment of the present invention may include the structure of the releasable latch illustrated at FIGS. 2A, 2B, and 2C of U.S. Pat. No. 4,570,707, issued Feb. 18, 1986, to John R. Setterberg, Jr., and assigned to Otis Engineering Corporation, incorporated herein by reference. The patented structure is adapted to the present invention by installing the ring seals 40 around the outside of the cylinder portion 42 below the shear pins 45 and the wiper seal 43 within the cylinder 42, FIG. 2B, in the relationship shown in FIG. 1 of the present application. This provides the ring seals in the cylinder 42 to seal around the cylinder with the internal bore of the housing 25, and the wiper seal to seal between the cylinder 42 and the external surface of the mandrel portion **41*b*. Further, additional length is provided in the cylinder 41 below the recess 54 of the patented structure to give sufficient length for spacing out of the extension joint. Correspondingly, additional length is provided in the housing 25, FIG. 2C of the patent, to permit the extension joint to move sufficiently upwardly and downwardly to perform the desired function. In this embodiment, the device is latched in place by the last downward movement of the tubing string and the tubing is released from the trash barrier by the next upward movement of the tubing string. The last downward movement of the tubing string shears the pins 45 to latch the trash barrier carrying the ring seals and the wiper seal by means of the collet heads 44 of the patented apparatus, with the snap ring 53 entering the recess 54 so that the upward movement of the tubing string causes the ring 53 to engage the ring 52 shearing the pins 51** to release the tubing string for spacing out functions. This modification of the patented structure in accordance with the present invention thereby provides a trash barrier which is latched into place with the last downward movement of the tubing string and the extension joint is released by the next upward movement of the tubing string.

It will be seen that the tubing extension joint 10 including the trash barrier assembly 30 of FIGS. 1–4 is operated by only longitudinal movement of the tubing string T2. The extension joint 100 with the trash barrier 300 of FIGS. 4 and 5 is operated by rotation of the tubing string T2 and thereafter longitudinal movement of the tubing string. All embodiments of the invention provide protection for the seal 22 and the external and internal surfaces of the upper and lower and tubing string T2 and T1, respectively, by the barrier provided by the wiper seal 43 which keeps foreign matter out of the annular space between the tubing strings along the surfaces engaged by the sliding seal 22.

What is claimed is:

1. A trash barrier for a well tubing extension joint comprising:

a top sub having an open upper end for connection on the upper end of a lower tubing string;

a tubular body shaped to fit on an upper tubing string and sized for downward insertion into said upper end of said top sub to land in said top sub;

means on said body and in said top sub for releaseably latching said body in said top sub responsive to downward insertion of said body into said top sub;

a seal between said body and said top sub;

a wiper seal in said body for sealing with said upper well tubing string sliding through said body; and means for securing said body to said upper tubing string holding said body against longitudinal movement on said upper tubing string through said body for running said upper tubing string into a well with said trash barrier thereon and thereafter releasing said upper tubing string from said body for longitudinal movement through said wiper seal.

2. A trash barrier in accordance with claim 1 wherein said means on said body and said top sub for releaseably locking said body in said top sub comprises a locking recess in said top sub and collect fingers on said body engageable with said locking recess.

3. A trash barrier in accordance with claim 2 wherein said means for connecting said upper tubing string with said body comprises shear pins.

4. A trash barrier in accordance with claim 3 including a threaded connection between said upper well tubing string and said body for holding said body on said upper tubing string and for disengaging said well tubing string from said body after said shear pins are sheared; a guide lug in said top sub; and means providing a guide recess on said body operable with said guide lug for holding said body against rotation while said upper tubing string is unthreaded from said body.

5. A trash barrier for a well tubing extension joint for connecting an upper tubing string into a packer in a well bore comprising:

a top sub connectible on a mandrel of a packer, said top sub having an annular stop shoulder thereon and being provided with an internal locking recess profile;

a tubular trash barrier body shaped to telescope into said top sub, said trash barrier body having an external annular stop shoulder engageable with said stop shoulder on said top sub;

longitudinal collet fingers on said tubular body, said collet fingers having a locking profile engageable with said locking recess profile in said top sub for releaseably locking said body in said top sub;

said body having a lower end edge engageable within said top sub by a shoulder surface on said tubing string to remove said body from said top sub;

external annular seals on said body for sealing between said body and said top sub;

an internal annular wiper seal in said body for providing a sliding seal between said body and said tubing string through said body; and means for connecting said body on said tubing string while running said tubing string into said well bore and latching said body in said top sub and thereafter releasing said tubing string from said body for longitudinal movement of said string through said body and said wiper seal.

6. A trash barrier in accordance with claim 5 including thread means between said tubing string and said body for connecting said body on said tubing string and releasing said tubing string from said body when said body is landed and locked in said top sub and means on said top sub and said body for holding said body against rotation in said top sub while said threads between said body and said tubing string are unthreaded.

7. A trash barrier for use in an extension joint for a well tubing string to permit said tubing string to move relative to a packer in a well bore and protect the bore of said packer from trash in said well bore comprising:

a top sub connectible on a mandrel of said packer, said top sub having an internal locking recess profile and an internal annular stop shoulder;

a guide and locking lug in said top sub;

a tubular trash barrier body shaped to land and lock in said top sub, said body having an external annular stop shoulder engageable with said stop shoulder in said top sub;

an external guide and lock recess on said body engageable by said lug in said top sub to hold said body against rotation in said top sub when said body is landed and locked in said top sub;

a plurality of longitudinal, circumferentially spaced, collet fingers on said tubular body, said collet fingers having external locking boss profiles engageable with said locking recess profile in said top sub for releaseably locking said body against longitudinal movement in said top sub;

external, seal means on said body for sealing between said body and a bore of said top sub;

an annular internal wiper seal in said body for sealing with said tubing string sliding through said body to keep trash from entering an annular space between said tubing string and the bore of said top sub, said packer mandrel, and through said packer;

means in said body providing a threaded connection between said body and said tubing string for running said trash barrier on said tubing string into a well bore and releasing said tubing string from said body when said body is landed and looked in said top sub; and shear pin means for connecting said body with said tubing string while running said body on said tubing string into said well bore.

8. A trash barrier in accordance with claim 2 including means for locking said collet fingers on said body responsive to a last downward movement of said well tubing through said body and means for releasing said tubing string responsive to a next upward movement of said tubing string.

9. A trash barrier in accordance with claim 8 including an external annular locking recess along said tubing string moveable into said body responsive to said lastward downward movement of said tubing string in said body; a sleeve in said body around said tubing string; shear pins means between said body and said sleeve; and a snap ring in said body below said sleeve engageable with said locking recess along said tubing string responsive to said last downward movement of said tubing string in said body.

10. A trash barrier in accordance with claim 9 including an external annular locking surface along said tubing string for holding said collet fingers outwardly at locked positions.

* * * * *